US007008363B2

(12) United States Patent
Allen et al.

(10) Patent No.: US 7,008,363 B2
(45) Date of Patent: Mar. 7, 2006

(54) APPARATUS AND METHODS FOR FOLDING A NONBONDED NONWOVEN WEB

(75) Inventors: Martin A. Allen, Dawsonville, GA (US); Patrick L. Crane, Dawsonville, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/699,549

(22) Filed: Oct. 31, 2003

(65) Prior Publication Data

US 2005/0096205 A1 May 5, 2005

(51) Int. Cl.
*B31F 1/08* (2006.01)

(52) U.S. Cl. ..... 493/418; 493/123; 493/441; 493/450

(58) Field of Classification Search ..... 493/123, 493/418, 441, 450; 226/95, 97.1, 170; 270/41; 271/197

See application file for complete search history.

(56) References Cited

U.S. PATENT DOCUMENTS

| | | | | |
|---|---|---|---|---|
| 3,191,926 A | | 6/1965 | Ramaika | 270/86 |
| 3,502,322 A | * | 3/1970 | Broadbent | 493/23 |
| 3,763,571 A | | 10/1973 | Vits | 34/57 A |
| 3,854,917 A | | 12/1974 | McKinney et al. | 65/3 |
| 4,421,501 A | | 12/1983 | Scheffer | 493/439 |
| 4,488,927 A | | 12/1984 | Hooper | 156/464 |
| 4,520,615 A | * | 6/1985 | Engler et al. | 53/550 |
| 4,614,512 A | * | 9/1986 | Capdeboscq | 493/441 |
| 4,682,977 A | | 7/1987 | Buxton | 493/358 |
| 4,809,446 A | | 3/1989 | Langer | 34/156 |
| 5,007,890 A | | 4/1991 | Alverth et al. | 493/434 |
| 5,178,601 A | | 1/1993 | Lovenbrant | 493/423 |
| 5,300,007 A | * | 4/1994 | Kober | 493/23 |
| 5,334,128 A | | 8/1994 | Carrico et al. | 493/439 |
| 5,556,360 A | * | 9/1996 | Kober et al. | 493/23 |
| 5,921,908 A | * | 7/1999 | Bodan | 493/418 |
| 6,027,440 A | * | 2/2000 | Roth | 493/436 |
| 6,565,501 B1 | | 5/2003 | Trennepohl | 493/423 |
| 6,572,520 B1 | * | 6/2003 | Blumle | 493/450 |
| 2001/0012813 A1 | | 8/2001 | Bleumle | |

FOREIGN PATENT DOCUMENTS

| | | |
|---|---|---|
| EP | 1 225 263 | 7/2002 |
| SU | 613752 | 7/1978 |

OTHER PUBLICATIONS

*International Search Report for Corresponding European Application No. EP 04 02 4748*, Mailing Date: Mar. 31, 2005 (2 pages).

* cited by examiner

*Primary Examiner*—Stephen F. Gerrity
*Assistant Examiner*—Hemant M. Desai
(74) *Attorney, Agent, or Firm*—Wood, Herron & Evans, L.L.P.

(57) ABSTRACT

Apparatus and methods for folding a nonwoven web without mechanical contact against a folding surface. A first portion of the nonwoven web is secured to a collector by vacuum and a positive pressure differential is applied to a second portion of the moving nonwoven web. An unbalanced lifting force applied by the positive pressure differential causes the first portion to fold along a longitudinal fold line extending in a machine direction and to assume an overlapping relationship with the second portion. The vacuum assists in the folding process and maintains the overlapping relationship until the nonbonded nonwoven web is consolidated. One or more elastic strands or bands may be captured in the space defined between the overlapped first and second portions.

6 Claims, 3 Drawing Sheets

APPARATUS AND METHODS FOR FOLDING A NONBONDED NONWOVEN WEB

FIELD OF THE INVENTION

The invention relates generally to nonwoven webs and, in particular, to apparatus and methods for folding nonbonded nonwoven webs.

BACKGROUND OF THE INVENTION

Nonwoven webs made from overlapped or entangled filaments or fibers of melt-processable thermoplastic polymers are commonly produced using spunbond and meltblown processes. Nonwoven webs are incorporated into many consumer and industrial products, such as single-use or short-life hygienic products, disposable protective apparel, fluid filtration media, and durables like bedding and carpeting. Nonwoven webs are fashioned by the operation of a meltspinning apparatus in either a spunbond process or a meltblown process.

A spunbond process generally involves extruding a curtain of fine diameter, semi-solid filaments of one or more thermoplastic polymers from multiple rows of fine orifices in a spinneret. A voluminous flow of relatively cool process air is directed at the curtain of extruded filaments to quench the molten thermoplastic polymer. The filaments are attenuated or drawn to a specified diameter and oriented on a molecular scale by drag forces created by a high-velocity flow of process air. The drawn filaments are propelled by the high-velocity air flow in a filament/air mixture toward a forming zone and collected on a moving collector to form a continuous length spunbond nonwoven web.

A meltblown process also involves pumping a thermoplastic polymer from an extruder through a die to form a curtain of filaments. However, converging layers of heated air, typically discharged from slots or holes on opposite sides of the curtain of filaments, contact the filaments immediately after extrusion and, through concomitant drag forces, stretch and attenuate the filaments. The filaments are collected on a moving collector forming a continuous length meltblown nonwoven web. Generally, meltblown filaments are finer than spunbond filaments and meltblown nonwoven webs are more fragile than spunbond nonwoven webs. Nonetheless, spunbond and meltblown nonwoven webs are susceptible to damage arising from mechanical contact, particularly before consolidation by a process such as calendaring. After consolidation, the nonwoven web is wound into a roll and removed from the meltspinning apparatus to another location for forming a consumer or industrial product.

The consolidated nonwoven web may be unwound from the roll and then folded with a fold line extending longitudinally along its continuous length to form a finished product. One type of folding device is a stationary folding board or skid plates that defines a chute that mechanically contacts and guides portions of a moving nonwoven web in a curving manner effective to create a longitudinal fold. Other conventional folding devices include a convoluted folding belt that contacts and moves with a moving nonwoven web. The folding belt directs a portion of the nonwoven web in a twisting path that ultimately produces a longitudinal fold. However, such guides, chutes, formers and additional moving belts of conventional web folding apparatus cannot be used in an in-line process with a meltspinning apparatus to longitudinally fold an unconsolidated nonwoven web, as the mechanical contact would damage the nonwoven web in this fragile state.

In view of the deficiencies in conventional web folding apparatus discussed above, it would be desirable to provide an apparatus capable of creating a longitudinal fold in an unconsolidated nonwoven web either absent mechanical contact or, at the least, with a minimal level of mechanical contact.

SUMMARY

The invention provides an apparatus for folding a nonwoven web that includes a first vacuum device and a second vacuum device downstream in a machine direction from the first vacuum device. The first vacuum device is capable of applying a vacuum effective to attract a first portion and a second portion of a nonwoven web to a collector moving in the machine direction. The second vacuum device includes at least one air inlet opening positioned to underlie the collector. The vacuum device is capable of applying a vacuum through the at least one air inlet opening to the first portion effective to attract the first portion to the collector. The vacuum also aspirates air through the second portion effective to move the second portion relative to the first portion along a fold line extending in the machine direction and thereby establishes an overlapping relationship with the first portion.

The invention also provides an apparatus for folding a nonwoven web moving on a collector in which the apparatus features a vacuum device including at least one air inlet opening positioned to underlie the collector and a positive pressure device including at least one air outlet opening positioned to underlie the collector proximate to the at least one air inlet opening. The vacuum device is capable of applying a vacuum to a first portion of a nonwoven web through the at least one air inlet opening effective to attract the first portion to the collector. The positive pressure device is capable of applying a forced air flow through the at least one air outlet opening to a second portion of the nonwoven web effective to move the second portion relative to the first portion along a fold line extending in the machine direction and thereby establish an overlapping relationship with the first portion after folding. The apparatus is used in conjunction with a melt-spinning device capable of discharging a stream of filaments collected by the collector to form the nonwoven web.

In accordance with the principles of the invention, an apparatus for forming a nonwoven web includes a melt-spinning device capable of discharging a stream of filaments and a collector moving in a machine direction. The collector collects the stream of filaments discharged by the melt-spinning device to form a nonwoven web. The apparatus further includes a transfer zone downstream in the machine direction from the melt-spinning device in which vacuum is applied through the collector to a first portion and a second portion of the nonwoven web and an initial folding zone downstream in the machine direction from the transfer zone in which vacuum is applied through the collector to the first portion. A folding zone downstream in the machine direction from the initial folding zone applies vacuum through the collector to the first portion and a positive pressure differential through the collector to the second portion. The positive pressure differential transfers momentum to the second portion causing the second portion to move relative to a fold line, past the perpendicular axis along the fold line. The vacuum subsequently attracts the second portion toward the first portion to establish an overlapping relationship in which the second portion of the nonwoven web lays flat over the first portion of the nonwoven web.

In accordance with the principles of the invention, a method is provided for folding a nonwoven web. The method includes forming the nonwoven web on a collector in a forming zone, moving the collector in a machine direction for transporting the nonwoven web away from the forming zone, applying a negative pressure differential or vacuum to a first region of the nonwoven web and applying a positive pressure differential, preferably simultaneously with the vacuum, to a second region of the nonwoven web. The vacuum attracts the first region to the collector. The positive pressure differential causes the second region to fold toward the first region about a fold line extending in the machine direction.

In accordance with an alternative embodiment, a method for folding a moving nonwoven web includes forming the nonwoven web on a collector in a forming zone and moving the collector in a machine direction for transporting the nonwoven web away from the forming zone in a machine direction. A first negative pressure differential to the first portion and the second portion of the nonwoven web thereby attracting the first portion and the second portion to the collector. A second negative pressure differential is applied to the first portion of the nonwoven web downstream in the machine direction from the first negative pressure differential. The second negative pressure differential attracts the first portion to the collector and aspirates air through the second portion effective to fold toward the first portion about a fold line extending in the machine direction.

In accordance with principles of the invention, nonwoven webs may be folded with high degree of accuracy and at line speeds characteristic of web-forming process lines by a non-contact folding procedure. The web folding apparatus of the invention is easily incorporated into the process line as a passive in-line component downstream from a melt-spinning device. The web folding apparatus of the invention is simple, compact and may be installed as a retrofit unit in association with an existing melt-spinning device.

These and other objects and advantages of the present invention shall become more apparent from the accompanying drawings and description thereof.

BRIEF DESCRIPTION OF THE FIGURES

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE INVENTION

The invention is directed to an apparatus and methods for forming a longitudinal fold in a continuous length non-bonded, nonwoven web moving on a collector. To that end, impingement of a stream of a gas, such as air, transfers momentum to one portion of the nonwoven web for folding that portion over another portion of the web secured to the collector by vacuum. Although the invention will be described herein in terms of an exemplary system used for folding nonwoven webs, it should be understood that modifications to the exemplary system described herein could be made so as to conform any portion or the entire system to a particular need without departing from the intended spirit and scope of the invention.

Figure 1:
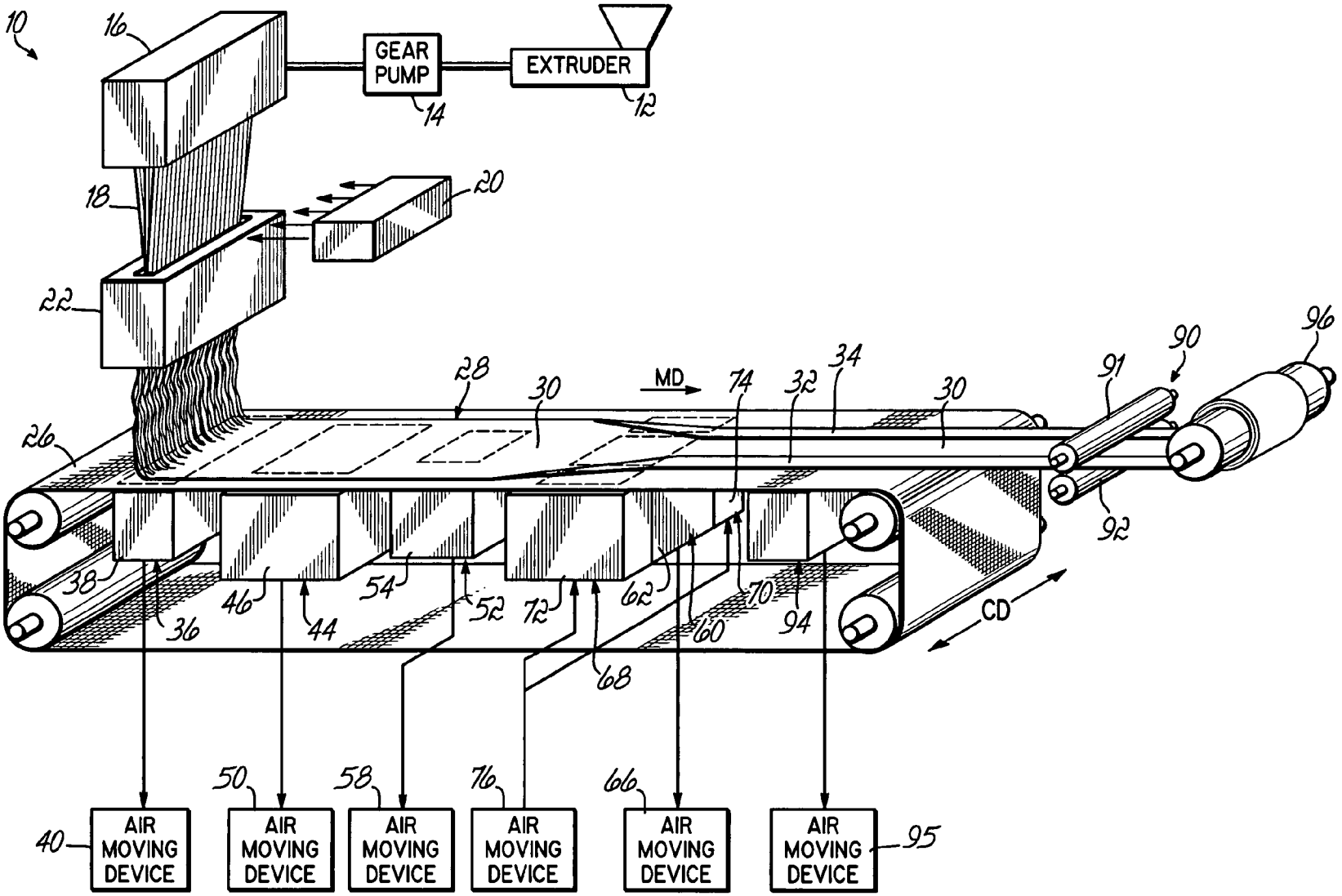
FIG. 1 is a schematic perspective view of a melt-spinning device capable of forming a nonwoven web and a folding apparatus in accordance with the principles of the invention.
Figure 2:
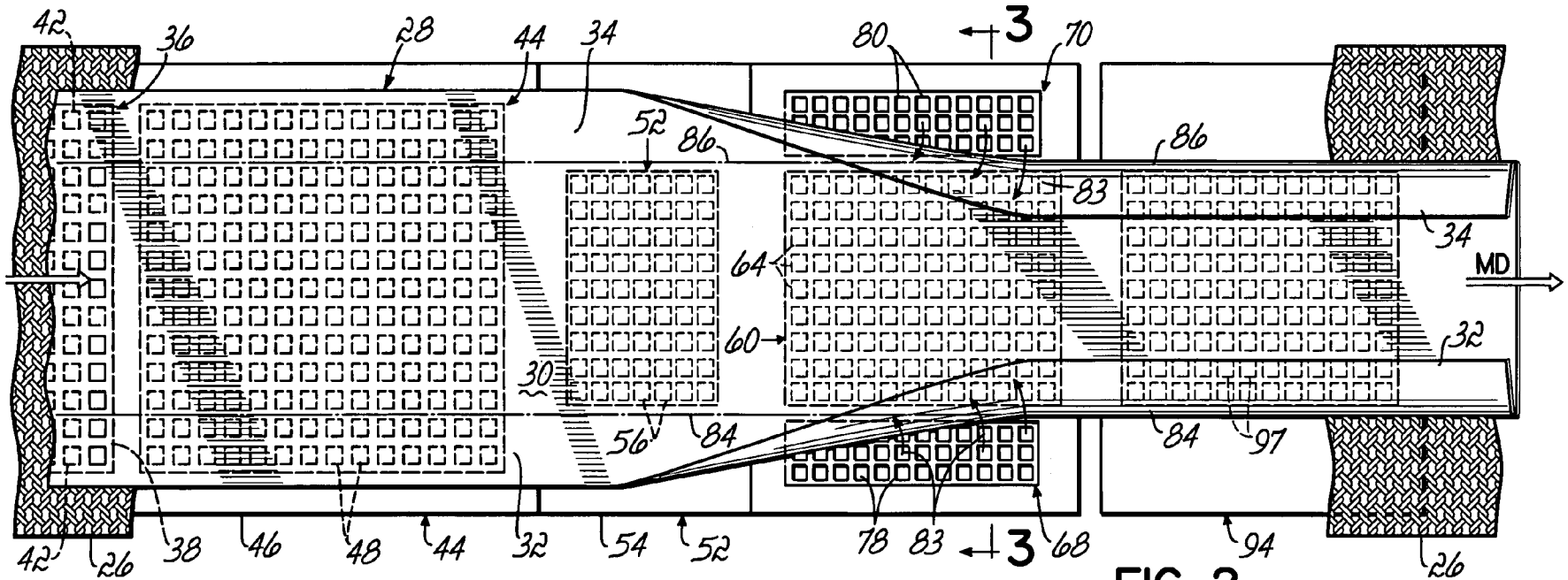
FIG. 2 is a top view of a portion of FIG. 1 detailing the folding apparatus.

With reference to FIGS. 1 and 2, a melt-spinning device 10 is equipped with an extruder 12 that converts solid thermoplastic polymer into a molten or semi-solid state. Gear pumps 14 pump the semi-solid thermoplastic polymer from the extruder 12 to an extrusion die or spinneret 16, which discharges a curtain of filaments 18. A second thermoplastic polymer may be supplied to the spinneret 16 for forming multi-component filaments 18. A cross-flow of cooling air from a quench blower 20 accelerates solidification of the airborne curtain of filaments 18. The filaments 18 are directed into a filament-drawing device 22, which envelops the filaments 18 with a tangential high velocity flow of process air to thereby apply a drag force in a direction substantially parallel to the length of the filaments 18. Because the filaments 18 are extensible, the drag force attenuates and molecularly orients the filaments 18. The curtain of attenuated filaments 18 exiting the filament-drawing device 22 is deposited or laid down in a substantially random and preferably uniform manner in the form of a nonwoven web 28 on a horizontally and linearly moving perforated collector 26. The collector 26 spans the width of the spinneret 16 and moves in a machine direction, represented by the arrow labeled MD, extending along the length of the nonwoven web 28 in the direction in which it is produced.

The collector 26 mechanically supports the nonwoven web 28 as web 28 is transported in the machine direction. Generally, the nonwoven web 28 is a flexible continuous sheet layer having a structure of individual filaments 18 interlaid in a random manner to have an open, porous structure. The porous structure of the nonwoven web 28 presents a resistance to gas flow therethrough sufficient to apply an unbalanced force to the web 28 if a positive or negative pressure differential is applied to a surface of the nonwoven web 28 confronting the collector 26. The invention contemplates that the nonwoven web 28 may be formed from fibers or filaments originating from a meltblowing process, in addition to or instead of the illustrated spunbond process. In certain embodiments of the invention, the nonwoven web 28 may constitute a laminate of two or more layers such as, for example, a spunbond/meltblown/spunbond (SMS) laminate. The invention contemplates that the principles of the invention are applicable for use with any suitable meltspinning apparatus including, but not limited to, meltspinning apparatus 10, that is capable of forming a nonwoven web on a collector.

With continued reference to FIGS. 1 and 2, the nonwoven web 28 includes a central portion 30, a left peripheral portion 30, and a right peripheral portion 34. The peripheral portions 32, 34 flank the central portion 30 and extend inwardly from one of the opposite side edges of the nonwoven web 28 in a cross-machine direction, represented by the double-headed arrow labeled CD, generally perpendicular to the machine direction. The center region 30 interconnects the peripheral portions 32, 34 to define an integral and continuous structure.

With continued reference to FIGS. 1 and 2, located beneath the collector 26 and generally underneath the filament-drawing device 22 is a forming zone 36 in which a negative pressure differential or vacuum is applied so that the filaments 18 lay down on the collector 26 to form nonwoven web 28. The collector 26 is porous and gas-permeable for effectively transferring a vacuum through the collector thickness with a nominal pressure drop. The forming zone 36 includes a collecting duct 38 situated below the collector 26 and an air-moving device 40, such as a blower, a fan or a vacuum pump, communicating with the collecting duct 38. The air-moving device 40 actively draws process air discharged from the filament-drawing device 22 and secondary air entrained by the process air into air inlet openings 42 formed in the collecting duct 38 beneath the collector 26. The air inlet openings 42 are distributed in an arrangement effective for applying a substantially uniform vacuum in the cross-machine direction across the width of the forming zone 36, which promotes uniform filament laydown and uniform basis weight of the nonwoven web 28 by reducing extraneous air currents.

A transfer zone 44 downstream from the forming zone 36 secures the nonwoven web 28 to the collector 26 with vacuum or suction for transport or transfer away from the forming zone 36. The transfer zone 44 includes a collecting duct 46 incorporating multiple air inlet openings 48 located vertically below the collector 26. An air-moving device 50, such as a blower, a fan or a vacuum pump, coupled in communication with the collecting duct 46 actively draws air from the ambient environment successively through the air inlet openings 48, the nonwoven web 28 and the collector 26 into the collecting duct 46. A negative pressure differential applied to the nonwoven web 28 within the transfer zone 44 attracts the nonwoven web 28 to the collector 26 for the length of its travel path in the machine direction overlying the collecting duct 46. The air inlet openings 48 span the cross-machine dimension of the collector 26 and, therefore, the nonwoven web 28 for securing the central portion 30 and peripheral portions 32, 34 of the nonwoven web 28 to the collector 26. The nonwoven web 28 is transferred or transported on the collector 26 away from the forming zone 36 over an arbitrary distance in the transfer zone 44 while vacuum is applied across the entire cross-machine dimension.

With continued reference to FIGS. 1 and 2, downstream from the transfer zone 44 is an initial folding zone 52 including a collecting duct 54 and multiple air inlet openings 56 in the collecting duct 54 positioned beneath the collector 26. An air-moving device 58, such as a blower, a fan or a vacuum pump, coupled in communication with the collecting duct 54 actively draws air from the ambient environment successively through the nonwoven web 28, the collector 26 and the air inlet openings 56 into the collecting duct 54. Initial folding zone 52 applies a negative pressure differential that attracts the central portion 30 of nonwoven web 28 to the collector 26 for the segment of its travel path in the machine direction overlying the collecting duct 54. However, the air inlet openings 56 span less than the full cross-machine dimension of the collector 26. As a result, the vacuum applied to the central portion 30 is maintained as the nonwoven web 28 moves from the transfer zone 44 to the initial folding zone 52 and the peripheral portions 32, 34 of the nonwoven web 28 are no longer attracted to the collector 26 by a negative pressure differential.

Figure 3A:
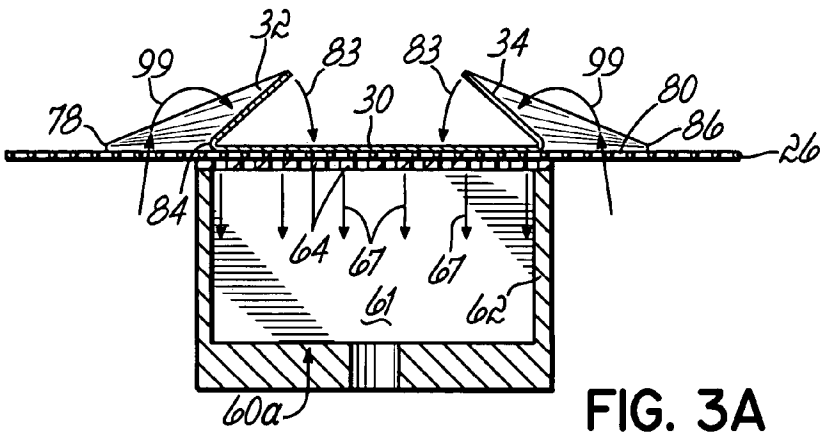
FIG. 3A is a cross-sectional view similar to FIG. 3 of a folding apparatus in accordance with an alternative embodiment of the invention.
Figure 3:
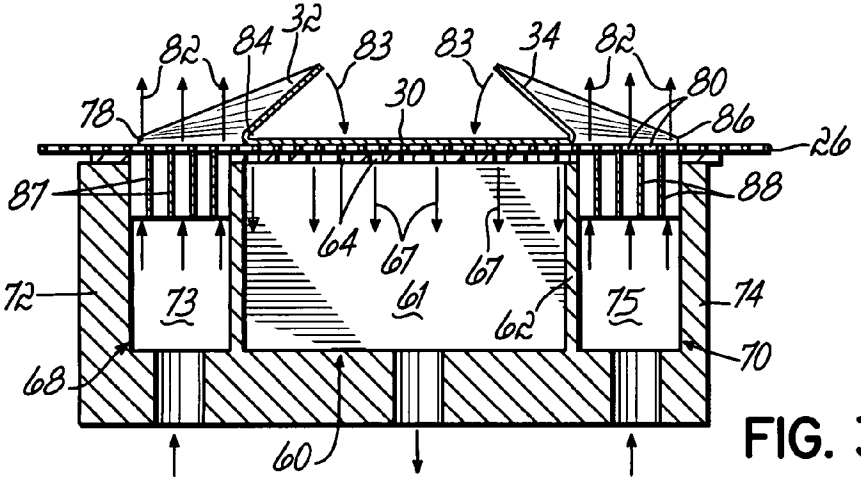
FIG. 3 is a cross-sectional view taken generally along lines 3—3 of FIG. 2.

With reference to FIGS. 1–3, a folding zone 60 downstream from initial folding zone 52 includes a collecting duct 62 enclosing an air plenum 61 having multiple air inlet openings 64 arranged to underlie the collector 26. The air plenum 61 of collecting duct 62 communicates with, and is evacuated by, an air-moving device 66, such as a blower, a fan or a vacuum pump. The vacuum actively draws or aspirates air from the ambient environment above the nonwoven web 28, which successively permeates through the nonwoven web 28, the collector 26 and the air inlet openings 64 into the air plenum 61, as is depicted by arrows 67 representing the flow of air. The aspiration applies a negative pressure differential to the central portion 30 of the nonwoven web 28, which attracts central portion 30 to the collector 26 for the portion of its travel path in the machine direction that overlies the collecting duct 62. As a result, vacuum across the central portion 30 is maintained in the folding zone 60, as present in the initial folding zone 52.

The folding zone 60 further includes positive pressure regions 68, 70 that flank the air inlet openings 64 in the cross-machine direction. Positive pressure region 68 includes an exhaust duct 72 coupled in communication with an air-moving device 76, such as a blower, a fan, or a source of pressurized air like an air compressor. Similarly, positive pressure region 70 includes an exhaust duct 74 coupled in communication with air-moving device 76. Each exhaust duct 72, 74 includes a corresponding set of air outlet openings 78, 80, respectively, positioned laterally on opposite sides of air inlet openings 64 and vertically beneath the collector 26.

An upward forced flow of air exhausted from the exhaust ducts 72, 74 successively permeates through the air outlet openings 78, 80, the nonwoven web 28 and the collector 26, as is depicted by arrows 82 representing the substantially columnar air flow. The upward forced air flow applies an unbalanced lifting force directed away from the collector 26 to each successive length or section of the peripheral portions 32, 34 as those sections consecutively enter and overlie the corresponding set of air outlet openings 78, 80. The unbalanced lifting force applied to the peripheral portions 32, 34 is generally opposite, at least when the peripheral portions 32, 34 begin to overlie the air outlet openings 78, 80, to the unbalanced force applied in the folding zone 60 to the central portion 30. The peripheral portions 32, 34 move upward in response to the lifting force and the positive pressure differential applied to the downwardly-facing surfaces of peripheral portions 32, 34. The center region 30 of the nonwoven web 28 is attracted toward the collector 26 by the vacuum applied from air inlet openings 64. Vacuum applied through air inlet openings 48 of upstream transfer zone 44 (FIG. 2) across the entire width of the nonwoven web 28 anchors upstream lengths of the peripheral portions 32, 34 for the folding induced within folding zone 60.

With continued reference to FIGS. 1–3, the angular momentum applied to peripheral portion 32 by the lifting force causes peripheral portion 32 to lift from contact with the collector 26 and pivot or revolve, as represented by arrows 83, about a longitudinal fold line 84 defined adjacent to one lateral edge of air inlet openings 64. Similarly, the angular momentum applied to peripheral portion 34 by the lifting force causes peripheral portion 34 to lift from contact with the collector 26 and pivot or revolve, as represented by arrows 83, about a longitudinal fold line 86 defined adjacent to an opposite lateral edge of air inlet openings 64. The longitudinal fold lines 84, 86 are oriented substantially parallel to the machine direction.

The dwell time of the peripheral portions 32, 34 over the corresponding set of air outlet openings 78, 80, considered in conjunction with the velocity at which the web 28 is moved in the machine direction, is effective to create a lifting force effective to propel the peripheral portions 32, 34 toward the air inlet openings 64. The peripheral portions 32, 34 experience a continuous rotation or twisting over the extent of the folding from a first position having a contacting relationship with the collector 26 (0° C. rotation angle) to a second position having a contacting relationship with the center region 30 (180° rotation angle). At a 90° rotation angle, the peripheral portions 32, 34 are perpendicular to the central portion 30 and the upward lifting force is no longer applied by the air exhausted by air outlet openings 78, 80 to the corresponding one of the peripheral portions 32, 34. As the rotation angle exceeds 90°, each of the peripheral portions 32, 34 begins to overlie the central portion 30 and the negative pressure differential applied by the air inlet openings 64 attracts the peripheral portions 32, 34 toward the secured central portion 30 of the nonwoven web 28. Due to the attraction of the central portion 30 to the collector 26 in the initial folding zone 52 and the air inlet openings 64 of folding zone 60, the positive pressure differential causes the peripheral portions 32, 34 of the nonwoven web 28 to fold in a rolling manner upward and inward to assume a substantially flat, overlapping relationship with the central portion 30 of the nonwoven web 28.

The invention contemplates that, by eliminating one of the two positive pressure regions 68, 70, only one of the two peripheral portions 32, 34 of the nonwoven web 28 is folded. In accordance with this alternative embodiment of the invention, the width of the remaining one of the peripheral portions 32, 34 in the cross-machine direction may be less than, equal to or greater than the width of the central portion 30. For example, the remaining set of air outlet openings, for example, air openings 78, and air inlet openings 64 may be arranged such that fold line the nonwoven web 28 is folded in half along a central longitudinal fold line (not shown) extending parallel to the longitudinal centerline of web 28.

The invention further contemplates that the set of air inlet openings 64 may be omitted in its entirety such that the central portion 30 of the nonwoven web 28 is not attracted by a negative pressure differential toward the collector 26 in the folding zone 60. According to this embodiment of the invention, the upstream initial folding zone 52 and a downstream final or overlap zone 94 are effective to secure the central portion 30 of the nonwoven web 28 to the collector 26, and the downstream overlap zone 94 attracts and secures the peripheral portions 32, 34 against the central portion 30 during and after folding. The upstream initial folding zone 52 and downstream final or overlap zone 94 define the transverse location of the longitudinal fold lines 84, 86.

With continued reference to FIGS. 1–3, intersections between a set of partitioning walls 87, 88 in each of the exhaust ducts 72, 74 define the corresponding air outlet openings 78, 80. The partitioning walls 87, 88 are oriented such that the individual air streams from air outlet openings 78, 80 are substantially columnar and impinge the plane of the nonwoven web 28 initially at approximately 90° relative to the machine direction and at approximately 90° relative to the cross-machine direction. As the peripheral portions 32, 34 fold inwardly, the inclination between the individual air streams and the peripheral portions 32, 34 decreases until the air flow is tangential and the peripheral portions 32, 34 begin to experience the negative pressure differential applied by the air inlet openings 64 in folding zone 60. The invention contemplates that the geometry and inclination of the partitioning walls 87, 88 may be adjusted to direct or distribute some or all of the individual air streams in the machine direction, counter to the machine direction, and/or in the cross-machine direction. It is believed that inclining the individual air streams inwardly in the cross-machine direction will increase the angular momentum imparted to the peripheral portions 32, 34. As such, the partitioning walls 87, 88 effectively operate as an air baffle capable of profiling air flow from the air outlet openings 78, 80 in the machine and cross-machine directions.

The air-moving device 76 may be configured to adjust the velocity of the air streams emitted from the air outlet openings 78, 80. For example, the air-moving device 76 may be a variable-speed blower or an air compressor with a pressure-regulated output. The air velocity is selected such that the nonwoven web 28, which is nonbonded and fragile, is not damaged or degraded. The invention contemplates that each of the positive pressure regions 68, 70 may communicate with separate and distinct air-moving devices like air-moving device 76.

With continued reference to FIGS. 1–3, the nonwoven web 28 is transported, after folding, downstream in the machine direction to a calender 90 and passes through the nip of a pair of nip rollers 91, 92 constituting the calender 90. The overlap zone 94, similar to transfer zone 44, downstream from the folding zone 60 and the positive pressure regions 68, 70, applies a negative pressure differential from an air-moving device 95 to outlet openings 97 that secures the central portion 30 of the nonwoven web 28 to the collector 26. The nip rollers 91, 92 apply heat and pressure to flatten and consolidate the nonwoven web 28 in a direction normal to the plane of the web 28, which reduces the web thickness, bonds its filaments, and sets the longitudinal fold(s) at the location of the longitudinal fold lines 84, 86. The calendered nonwoven web 28 has a tensile strength sufficient such that it may be rolled up by a winder 96 for storage, transportation and unwinding to be cut into various shapes depending on the ultimate application form. For example, the nonwoven web 28 may be shaped to manufacture single-use or short-life hygienic products, disposable protective apparel, fluid filtration media, and durables like bedding and carpeting.

With reference to FIG. 3A in which like reference numerals refer to like features in FIG. 3 and in accordance with an alternative embodiment of the invention, a folding zone 60*a* includes collecting duct 62 enclosing an air plenum 61 evacuated by an air-moving device 66 and multiple air inlet openings 64. The central portion 30 of the nonwoven web 28 is attracted to the collector 26 by vacuum applied through air inlet openings 64, as present in the initial folding zone 52. However, folding zone 60*a* lacks positive pressure regions, such as positive pressure regions 68, 70 (FIGS. 2 and 3), that direct a forced flow of air at the peripheral portions 32, 34.

The vacuum applied through air inlet openings 56 of initial folding zone 52 (FIGS. 1 and 2) and air inlet openings 64 of folding zone 60*a* aspirates air from the ambient environment. Some of the aspirated air originates from beneath the peripheral portions 32, 34 of nonwoven web 28 and is drawn through peripheral portions 32, 34 and the corresponding underlying edges of the collector 26 into air inlet openings 56, 64. The concomitant flow of air, indicated diagrammatically by reference numeral 99 through the peripheral portions 32, 34, creates a negative pressure differential on the upper surface of the peripheral portions 32, 34 that causes the peripheral portions 32, 34 to move upward and pivot or revolve about longitudinal fold lines 84, 86, respectively, and eventually overlie the central portion 30.

Upstream from initial folding zone 52 and folding zone 60*a*, vacuum is applied through air inlet openings 48 of transfer zone 44 (FIG. 2) across the entire width of the nonwoven web 28 and, in particular, vacuum is applied to the peripheral portions 32, 34 as well as central portion 30. The vacuum attracts upstream lengths of the peripheral portions 32, 34 to the collector 26 and provides an anchor for the folding induced within initial folding zone 52 and folding zone 60*a*. The invention contemplates that the initial folding zone 52 and folding zone 60*a* may be combined to share a single collecting duct enclosed one air plenum evacuated by a common air-moving device.

Figure 4:
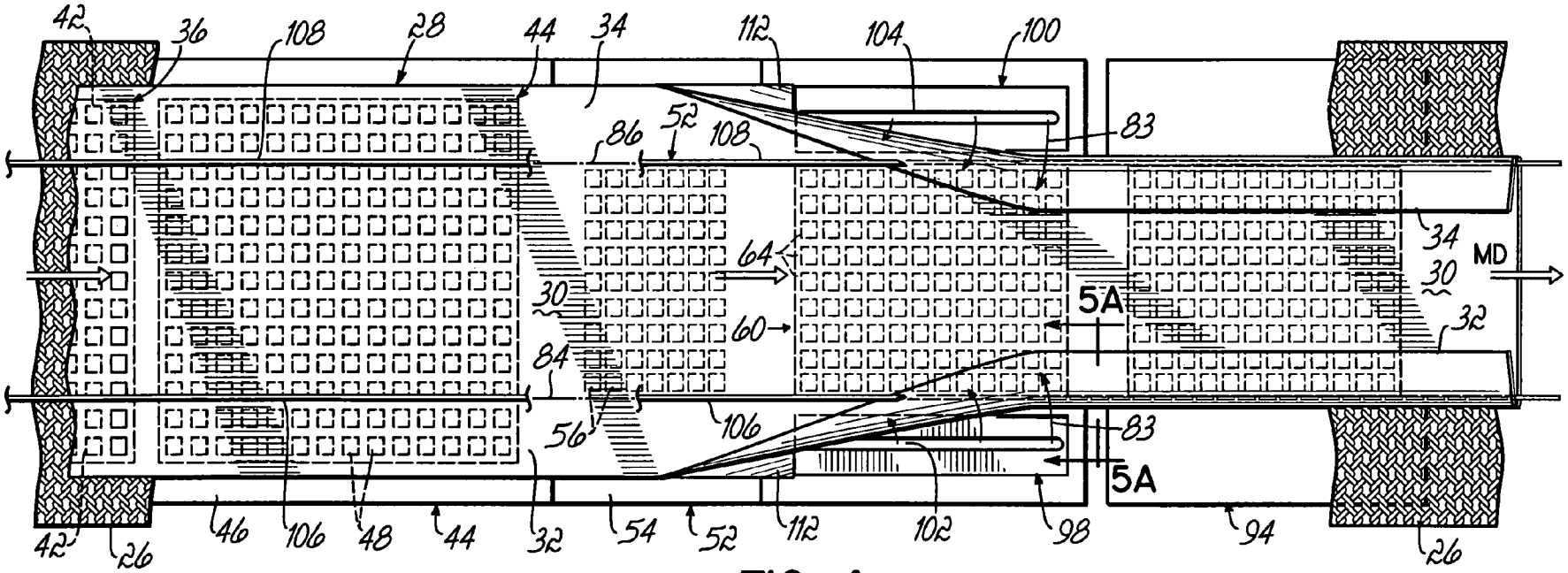
FIG. 4 is a top view similar to FIG. 2 of a folding apparatus in accordance with an alternative embodiment of the invention.

With reference to FIG. 4 and in accordance with an alternative embodiment of the invention, stationary inclined ramps 110, 112 may be provided that contact and alter the direction of motion of the peripheral portions 32, 34 as the nonwoven web 28 is conveyed past inclined ramps 110, 112 by collector 26. The directional change imparts angular momentum to the peripheral portions 32, 34 that assists or supplements the pneumatic folding action of positive pressure regions 98, 100. Specifically, each of the inclined ramps 110, 112 contacts an underside of a corresponding one of the peripheral portions 32, 34 as the nonwoven web 28 is conveyed past the inclined ramps 110, 112 in the machine direction on collector 26. Each of the inclined ramps 110, 112 is contoured with a surface that causes the corresponding contacting one of the peripheral portions 32, 34 to be directed in a curved path relative to the flat central portion 30. Although mechanical contact is not required for folding nonwoven web 28, inclined ramps 110, 112, or other types of conventional web folding apparatus, may be used in conjunction with positive pressure regions 98, 100 or with positive pressure regions 68, 70 (FIGS. 1–3) for folding the peripheral portions 32, 34 along longitudinal fold lines 84, 86.

Figure 5B:
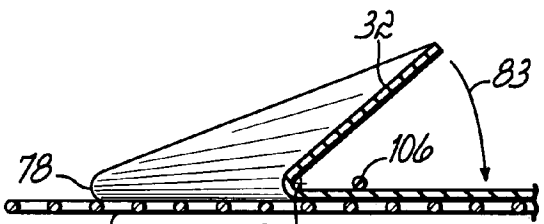
FIG. 5B is a cross-sectional view similar to FIG. 5A.
Figure 5A:
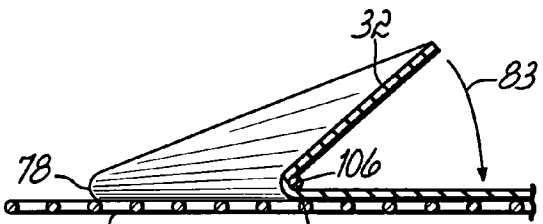
FIG. 5A is a cross-sectional view taken generally along lines 5A—5A of FIG. 4.

With reference to FIGS. 4 and 5A in which like reference numerals refer to like features in FIGS. 1–3 and in an alterative embodiment of the invention, a pair of positive pressure regions 98, 100 flanking folding zone 60 may each include a single elongate slot 102, 104 respectively, having a major axis extending in the machine direction. Air emitted from each slot 102, 104 applies an upward force that progressively folds the peripheral portions 32, 34 of the nonwoven web 28 along the corresponding longitudinal fold lines 84, 86 without mechanical contact to create an overlapping relationship with the central portion 30, as described herein. The side wall of the slots 102, 104 may be inclined to direct some or all of the air stream in the machine direction, counter to the machine direction, and/or in the cross-machine direction. In addition, the major axis of each slot 102, 104 may be angled or inclined relative to the machine direction so that the air flow better corresponds with the progressively rolled profile of the peripheral portions 32, 34. Alternatively, the length or major axis of each slot 102, 104 may also be lengthened or shortened for adjusting the extent of the air stream in the machine direction. Alternatively, the width of each slot 102, 104 in the cross-machine direction may be tapered for adjusting the air flows at different positions along the length.

Longitudinally-extending strands or bands 106, 108, which may be elastic or non-elastic, are each positioned a distance inward from each peripheral portion 32, 34 of the nonwoven web 28. The bands 106, 108 may be unwound from a spool or reel (not shown) and, if elastic, are provided in a stretched or tensioned condition. The bands 106, 108 are positioned either vertically a short distance above a plane containing the nonwoven web 28 or in a contacting relationship with the nonwoven web 28. The bands 106, 108 provide corresponding guide axes for defining longitudinal fold lines 84, 86 along which the peripheral portions 32, 34 of the nonwoven web 28 fold in response to the positive pressure differential applied by the positive pressure regions 98, 100. Locating the bands 106, 108 axially coincident with the longitudinal fold lines 84, 86 may permit elimination of the set of air inlet openings 64 as the bands 106, 108 each provide a distinct physical axis of rotation.

The bands 106, 108 are secured with the constituent filaments 18 of nonwoven web 28 by use of adhesive bonds, heat bonds, pressure bonds, ultrasonic bonds, dynamic mechanical bonds, mechanical locking or intertwining, or any other suitable technique as recognized in the art. For example, calendering the nonwoven web 28 in calendar 90 may suffice to secure the bands 106, 108 with nonwoven web 28. Alternatively, the bands 106, 108 may be ultrasonically bonded with the nonwoven web 28 using an ultrasonic bonder, adhesively bonded to the nonwoven web 28 with dots or beads of adhesive, or heatless mechanical bonded to the nonwoven web 28 by applying pressure in the nip between a smooth roller and an embossed roller.

If the bands 106, 108 are elastic, the peripheral portions 32, 34 of the nonwoven web 28 may be elasticized. For example, the elastic bands 106, 108 may be used to produce elasticized waist areas and leg cuffs for a disposable hygienic article. Such elastic bands and elastic strands suitable for use in the invention are commercially available, for example, from E. I. Dupont de Nemours and Company (Wilmington, Del.).

With reference to FIG. 5B in which like reference numerals refer to like features in FIG. 5A, band 106 may be displaced inwardly toward a centerline of the central portion 30 so that, after folding, band 106 is positioned in the space between the central portion 30 and the folded peripheral portion 32 but not collinear with the longitudinal fold line 84. Band 108 may have a similar non-aligned relationship with longitudinal fold line 86. In accordance with this alternative embodiment of the invention, one or both bands 106, 108 do not coincide axially with the longitudinal fold lines 84, 86. The invention further contemplates that additional bands, similar or identical to bands 106, 108, may be positioned relative to the central portion 30 such that, after folding, the additional bands are likewise located in the space between the folded peripheral portions 32, 34 and the central portion 30.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. For example, longitudinal folds in accordance with the principles of the invention may be formed in other types of continuous length webs such as plastic films, foams, tissues, rubbers, metal foils and other materials, either separately or in combination, and in single-layer or multiple-layer arrangements. The invention in its broader aspects is therefore not limited to the specific details, representative apparatus and methods, and illustrative examples shown and described. Accordingly, departures may be made from such details without departing from the spirit or scope of applicants' general inventive concept. The scope of the invention itself should only be defined by the appended claims.

We claim:

1. A method for folding a moving nonwoven web having a first portion adjoining an adjacent second portion, comprising:

forming the nonwoven web on a collector in a forming zone;

moving the nonwoven web on the collector in a machine direction away from the forming zone;

applying a negative pressure differential to the first portion of the nonwoven web; and applying a positive pressure differential to a second portion of the nonwoven web thereby causing the second portion to fold toward the first portion about a fold line extending in the machine direction.

2. The method of claim 1 further comprising:

applying the negative pressure differential to the first and second portions of the nonwoven web after folding about the fold line.

3. The method of claim 1 further comprising:

extending a continuous elastic member in the machine direction adjacent to the nonwoven web; and securing the continuous elastic member in a space to be defined between the second portion and the first portion after folding about the fold line.

4. The method of claim 1 further comprising:

contacting the second portion with an inclined ramp upstream of the positive pressure differential for moving the second portion relative to the first portion.

5. A method for folding a moving nonwoven web having a first portion adjoining an adjacent second portion, comprising:

forming the nonwoven web on a collector in a forming zone;

moving the nonwoven web on the collector in a machine direction away from the forming zone;

applying a negative pressure differential to the first portion and the second portion of the nonwoven web;

removing the negative pressure differential from the second portion of the nonwoven web; and aspirating air through the second portion effective to fold the second portion toward the first portion about a fold line extending in the machine direction.

6. The method of claim 5 further comprising:

extending a continuous elastic member in the machine direction adjacent to the nonwoven web; and securing the continuous elastic member in a space to be defined between the second portion and the first portion after folding about the fold line.

* * * * *